US005167097A

United States Patent [19]

Robbie et al.

[11] Patent Number: 5,167,097

[45] Date of Patent: Dec. 1, 1992

[54] RETRACTABLE STADIUM ROOF

[76] Inventors: Roderick G. Robbie, 16 Cornish Road, Toronto, Ontario, Canada, M4T 2E2; Christopher M. Allen, 18 Birchview Road, Ottawa, Ontario, Canada, K2G 3G4

[21] Appl. No.: 629,015

[22] Filed: Dec. 18, 1990

Related U.S. Application Data

[63] Continuation of Ser. No. 304,262, Jan. 31, 1989, abandoned.

[51] Int. Cl.[5] ..... E04H 3/10; E04B 7/16

[52] U.S. Cl. ..... 52/6; 52/66

[58] Field of Search ..... 52/6, 64, 66, 80

[56] References Cited

U.S. PATENT DOCUMENTS 4,676,033 6/1987 Allen et al. ..... 52/6

4,716,691 1/1988 Allen et al. ..... 52/6

OTHER PUBLICATIONS

Architectural Record: May 1959 pp. 250–251.

*Primary Examiner*—Michael Safavi

*Attorney, Agent, or Firm*—Smart & Biggar

[57] ABSTRACT

A retractable roof for a stadium, comprising a central arch separating a pair of end segments, one end segment being fixed, the central arch being movable to a position above the fixed end segment, the other end segment being movable arcuately laterally to a position transverse to its closed position and laterally external to the central arch.

11 Claims, 11 Drawing Sheets

RETRACTABLE STADIUM ROOF

This application is a continuation of application Ser. No. 07/304,262, filed Jan. 31, 1989, now abandoned.

FIELD OF THE INVENTION

This invention relates to a stadium building having a retractable roof.

BACKGROUND OF THE INVENTION

Covered stadiums are presently in use to provide a controlled environment for outdoor sports events. Recently the present applicants have developed a stadium building with an improved retractable roof to take advantage of the natural environment when the weather is fine. Such a structure is disclosed in our U. S. Pat. No. 4,676,033 issued Jun. 30, 1987. Interest has now been shown in converting conventional covered stadiums to retractable roof stadiums because of the perceived advantages of the applicants' concept.

It is an object of the present invention to provide a retractable roof stadium which may be constructed on the site of an existing conventional covered stadium, allowing the existing stadium to continue to be operational while the retractable roof stadium is being constructed.

Interest has also been shown in providing new stadiums utilizing the retractable roof of the applicants' concept on sites having an elongated rectangular field but because of the basically circular configuration of the roof of the structure such a building would occupy excess lateral ground and if compressed into a smaller area it would reduce seating capacity at the corners of the field.

It is a further object of the invention to provide a retractable roof stadium utilizing a smaller area of land.

SUMMARY OF THE INVENTION

Essentially the invention consists of a retractable roof, for a stadium building, comprising a central arch separating a pair of end segments, one end segment being fixed, central arch being movable to a position above the fixed end segment, the other end segment being movable arcuately laterally to a position transverse to its closed position and laterally external to the central arch.

In another aspect the central arch has two barrel vaults movable into nesting relationship above the fixed end segment with the barrel vault adjacent the movable end segment nesting below the barrel vault which is adjacent the fixed end segment.

BRIEF DESCRIPTION OF THE DRAWINGS

An example embodiment of the invention is shown in the accompanying drawings in which.

DESCRIPTION OF THE DRAWINGS

Figure 1:
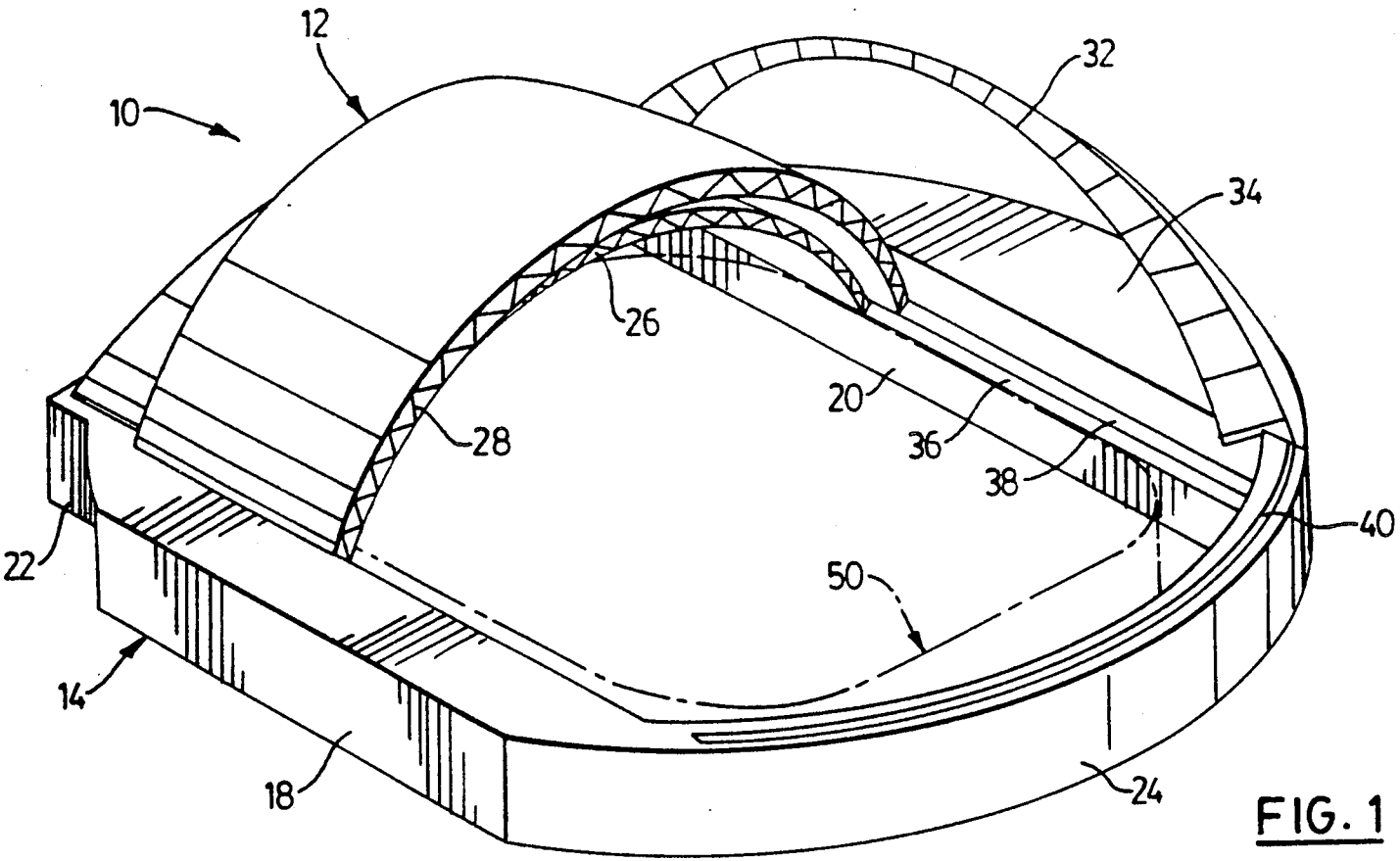
FIG. 1 is a perspective view of a stadium with the roof open.

The embodiment shown in the drawings consists of a stadium building 10 having a roof or dome 12 resting on a wall structure 14. Wall structure 14 comprises a pair of parallel, opposed side walls 18 and 20 together with end walls 22 and 24. roof 12 comprises a central arch having a pair of parallel barrel vaults 26 and 28 movably mounted on side walls 18 and a pair of opposed angular end segments 30 and 32. End segment 30 is fixed on end wall 22 and end segment 32 is mounted on end wall 24 which is arcuate in a horizontal plane. Side wall 20 includes a lateral arcuate base 34 which forms with arcuate end wall 24 a semi-circular support means or base on which end segment 32 is movably mounted.

Each end barrel vault 26 is carried on a row of trucks (not shown) which travel along a set of tracks 36 fixed on opposed side walls 18. Each end of barrel vault 28 is carried on a row of trucks (not shown) which travel along a set of tracks 38 also fixed on opposed side walls 18. End segment 32 is carried on a row of trucks (not shown) which travel on a set of tracks 40 on end wall 24 and portion 34 of side wall 18. The manner of mounting barrel vaults 26, 28 and end segment 32 on their respective tracks is fully described in our aforementioned U.S. Pat. No. 4,676,033 the contents of which are specifically incorporated herein by reference.

Figure 3:
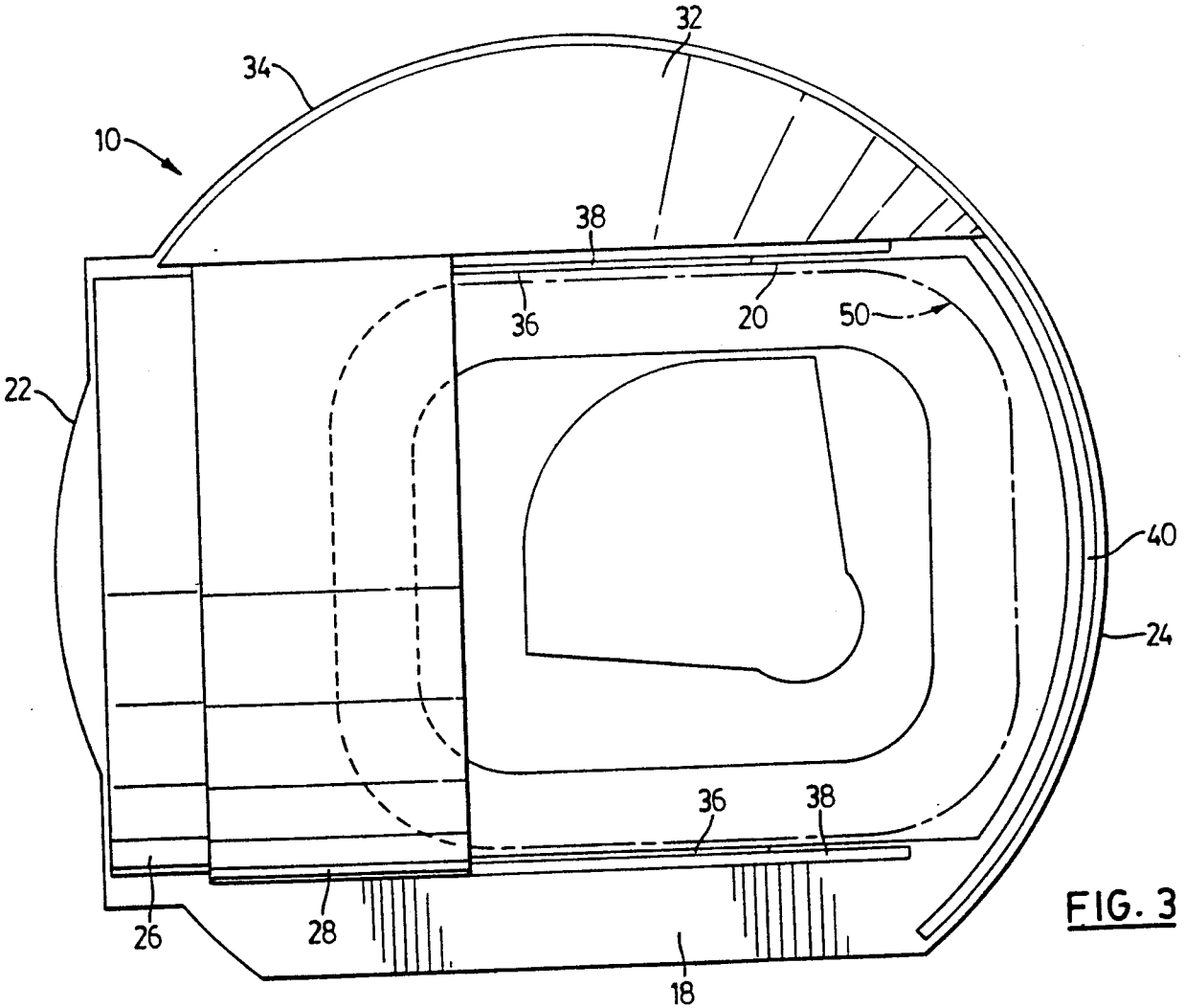
FIG. 3 is a plan view of the stadium of FIG. 1 with the roof open.

In construction and operation, stadium 109 may be built around an existing covered stadium 50 which is indicated in the drawings in chain-dotted outline. As seen in FIGS. 1 and 3 and in broken lines in FIGS. 5 and 6, roof 12, when open, has end segment 32 positioned on base 34 with its central horizontal axis at right angles to the central horizontal axis of the roof and being located laterally of tracks 36 and 38, i.e. laterally external to the path of travel of the central arch between its closed and its open position. Also in the open mode of roof 12, barrel vaults 28 and 28 are telescoped into a nesting position above fixed end segment 30 and end wall 22 extend rearwardly to accommodate tracks 36 and 38, as seen most clearly in FIG. 4.

Figure 2:
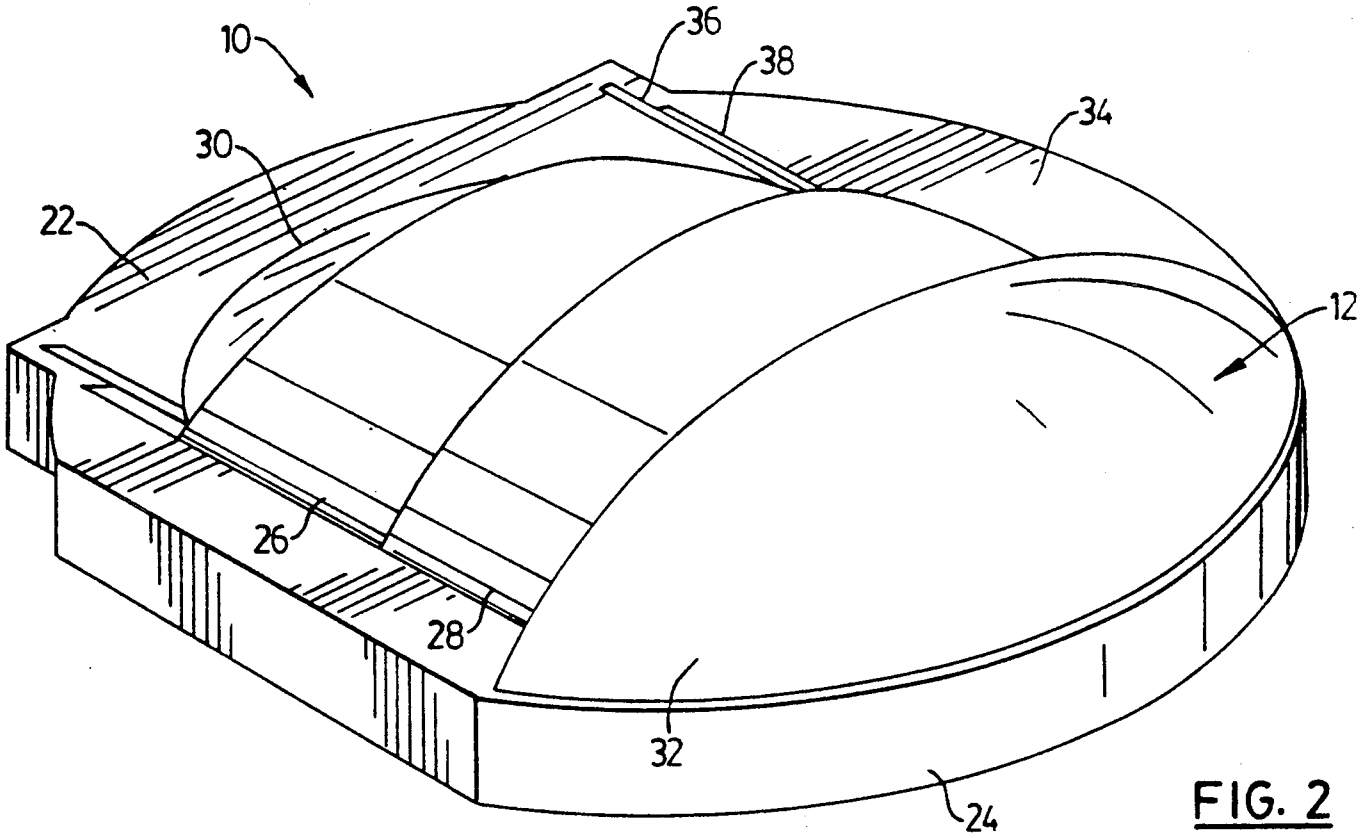
FIG. 2 is a perspective view similar to FIG. 1 with the roof closed.
Figure 4:
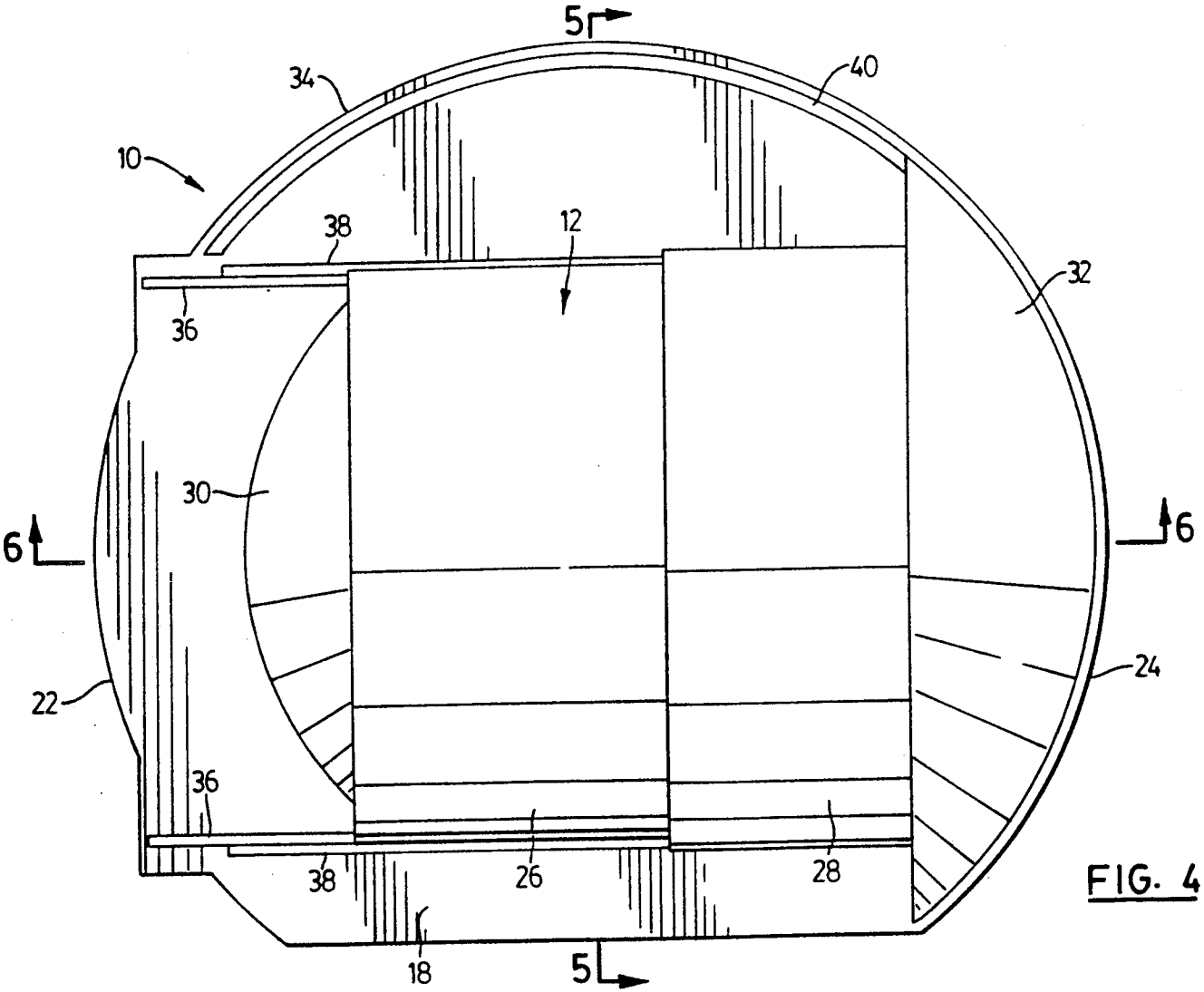
FIG. 4 is a plan view of the stadium of FIG. 1 with the roof closed.
Figure 5:
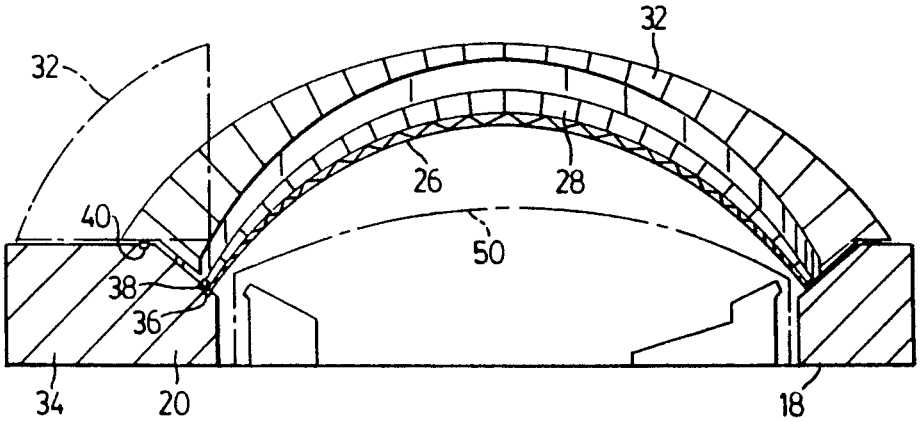
FIG. 5 is a cross-sectional view taken along line 5—5 of FIG. 4.
Figure 6:
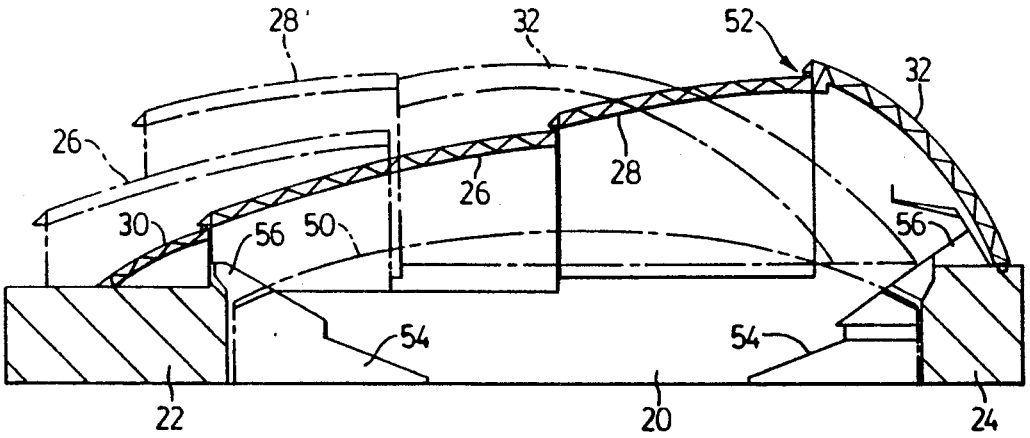
FIG. 6 is a cross sectional view taken along line 6—6 of FIG. 4.

To close roof 12, end segment 32 is moved along track 40 onto end wall 24 to have its central longitudinal axis coincide with that of the roof as a whole. Barrel vault 26 is moved along track 36 in the direction of end segment 32 and barrel vault 28 is moved along track 38 to abut end segment 32 as seen in FIGS. 2, 4 and 6. Suitable sealing means 52, for example downwardly extending flanges cooperating with a sealing element, completes the closure.

The construction of stadium 10 may be carried out while existing covered stadium 50 continues to be used.

In such construction portions of barrel vaults 26 and 28 are assembled and erected over base 22 which is constructed to one side of existing stadium 50. As each portion of a barrel vault 26 or 28 is completed it is moved along side walls 18 and 20, also newly erected, over stadium 50, allowing space for the erection of the remaining portions of the same vault. In like manner movable segment 32 is constructed over newly erected lateral base 34 associated with wall 20. In this manner there is no disruption of the normal activities of existing stadium 50. When stadium 10 is complete, roof 12 may be closed and used to assist in dismantling the roof of stadium 50. In fact the structure of stadium 10 may be attached to the supporting structure of stadium 50 and, as seen in FIG. 6, this would allow for the use of existing seating 54 and an extension 56 of that seating after the roof of stadium 50 has been removed.

It will be appreciated that the central arch, formed by barrel vaults 26, 28 in the described embodiment, may consist of one or more such vaults.

It will also be appreciated that fixed end segment 30 could be any shape, even a flat wall, to seal that end of roof 12 at end wall 22, and could include an overhang beneath the central arch.

Arcuate portion 34 of side wall 20 is shown as a solid cubic structure but any structure could be used which would support track 40, for example a colonnaded platform or deck.

Figure 7:
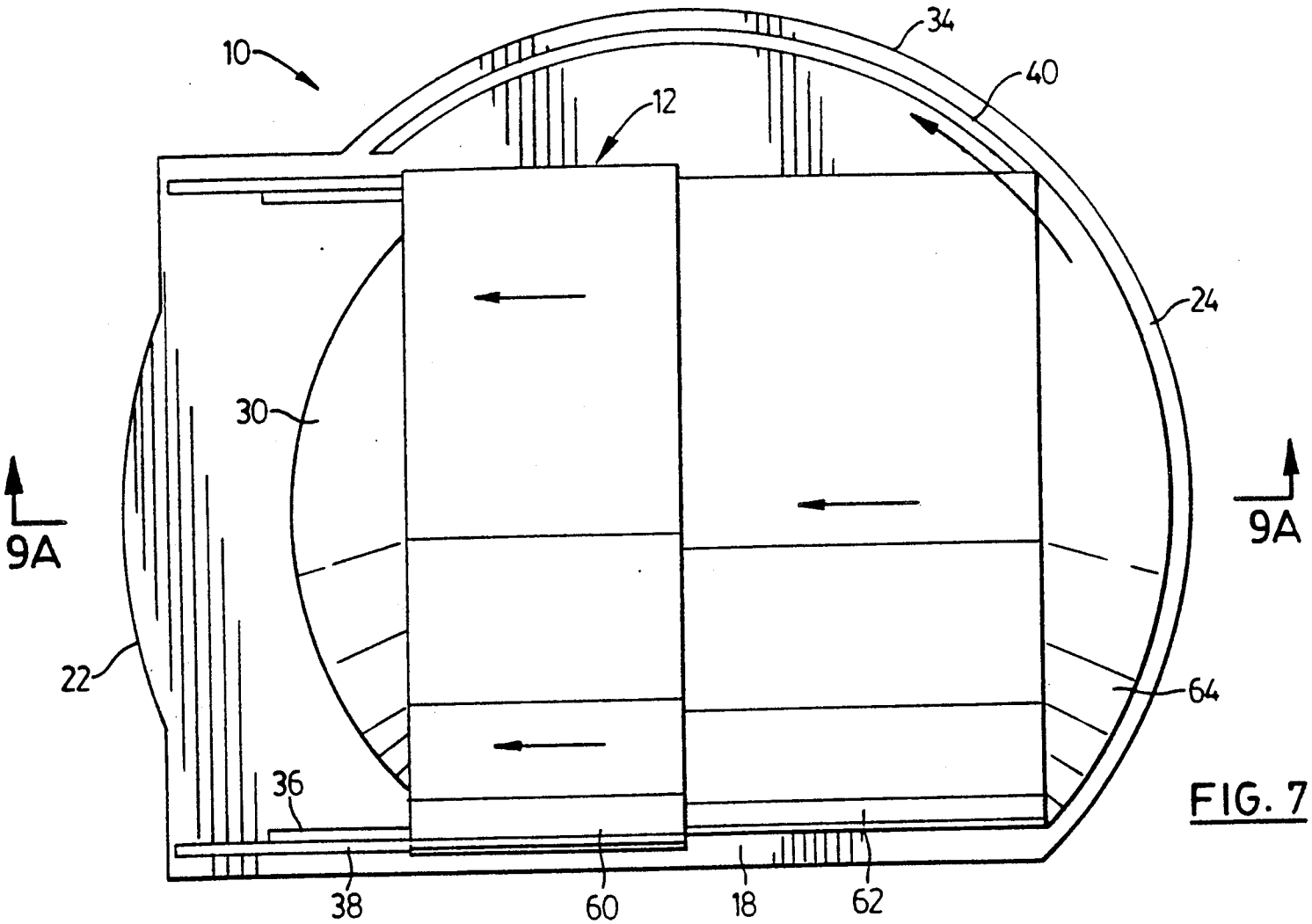
FIG. 7 is a plan view of first alternate embodiment of the invention showing a retractable roof stadium openable from the narrower end.
Figure 8:
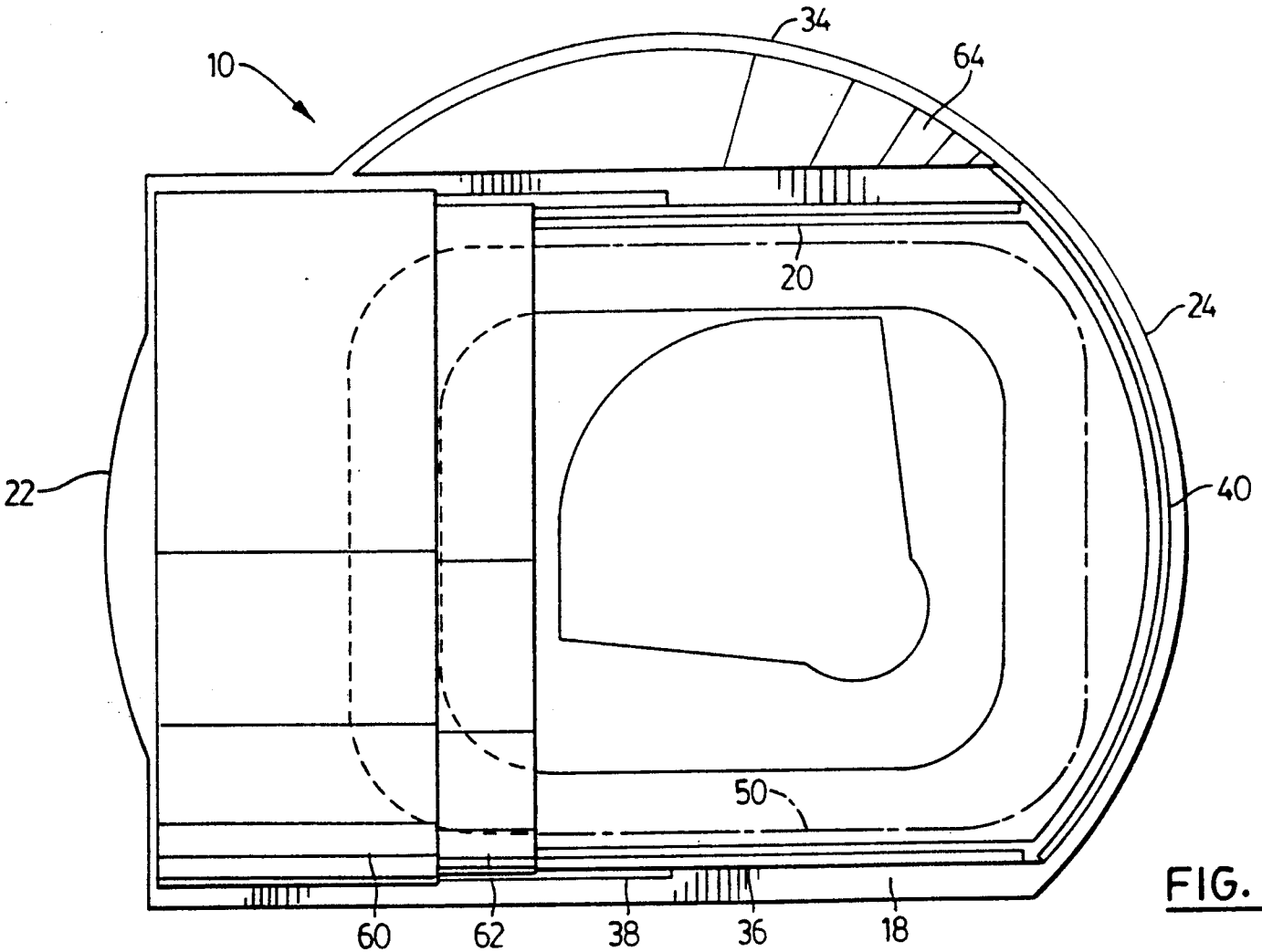
FIG. 8 is a plan view similar to FIG. 7 with the roof open.
Figure 9B:
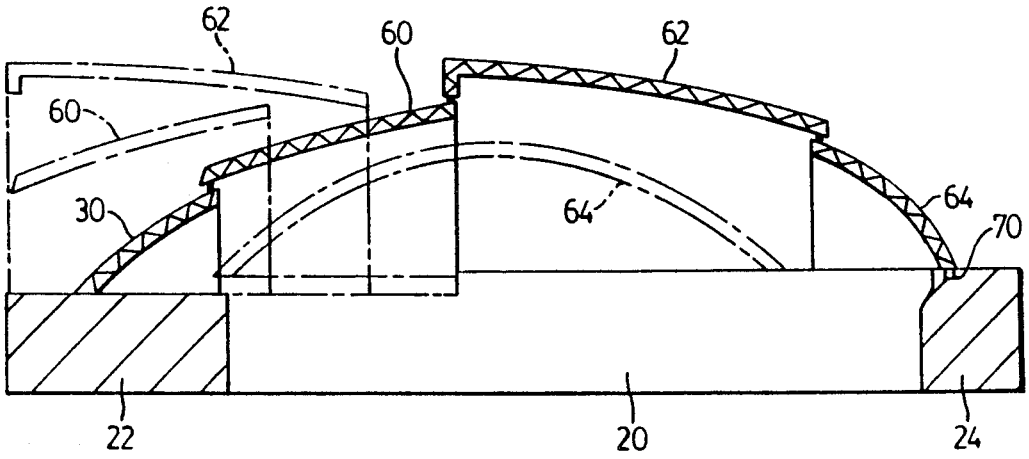
FIG. 9B is a cross-sectional view of an alternate embodiment similar to FIG. 9A but having the barrel vaults in reverse nesting position.
Figure 9A:
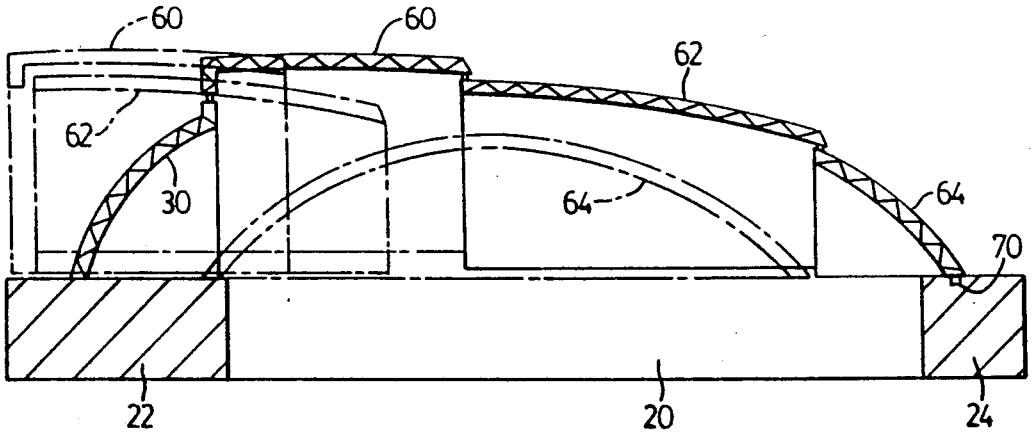
FIG. 9A is a cross-sectional view taken along live 9A—9A of FIG. 7

In the first alternate embodiment shown in FIGS. 7, 8 and 9 of the drawings consists of the central arch comprising a first barrel vault 60 adjacent fixed end segment 30 and a second barrel vault 62 adjacent a movable end segment 64 which covers the opening at the end of vault 62. Since end segment 64 is smaller than movable end segment 32 in the previous embodiment, lateral base 34 is smaller in area. FIGS. 9A (together with FIGS. 7 and 8) and 9B show two example arrangements of the elements of the roof structure to achieve this result.

Figure 10:
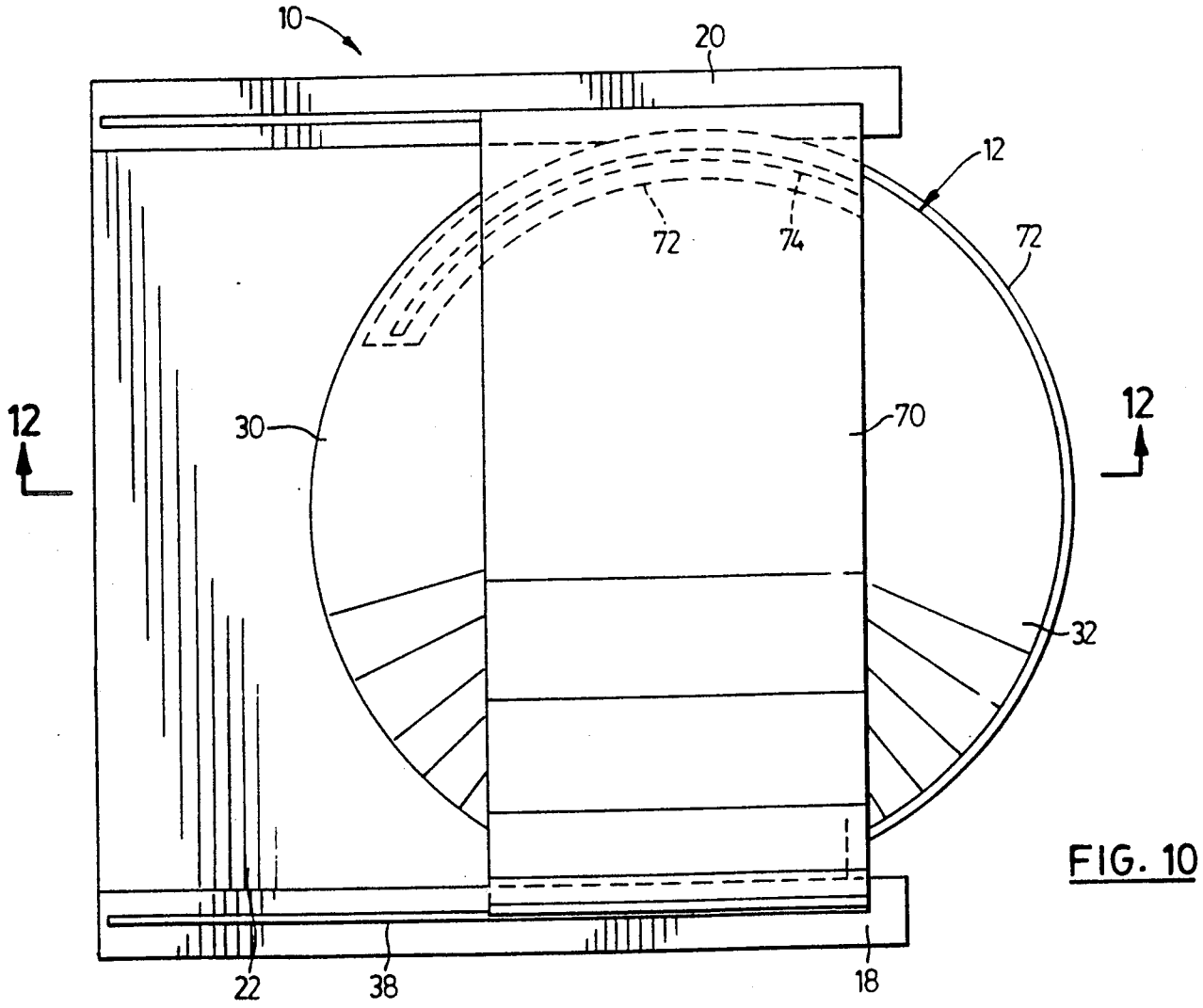
FIG. 10 is a second alternate embodiment of the invention showing the movable end segment movable to a position inside the side wall.
Figure 11:
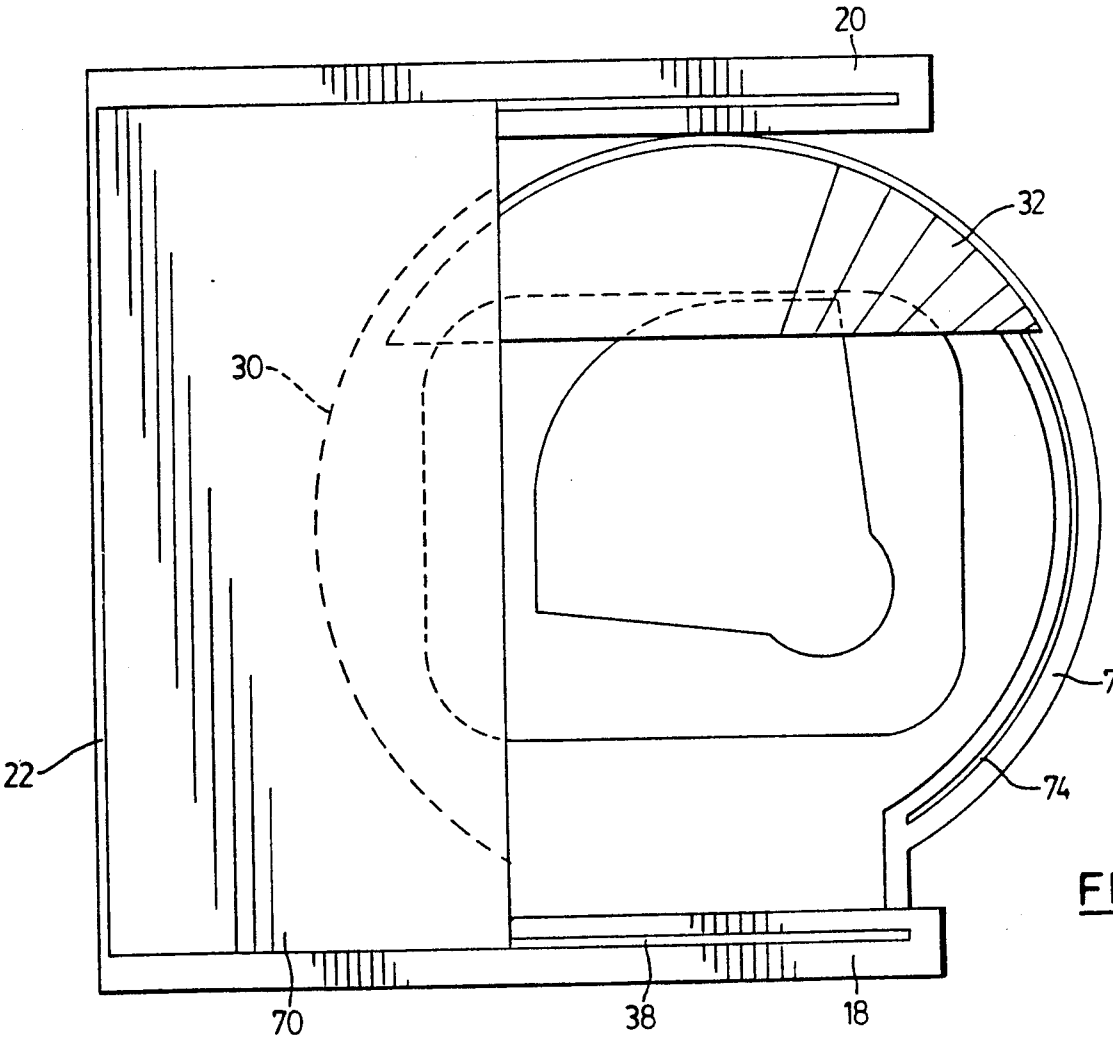
FIG. 11 is a view similar to FIG. 9 showing the stadium roof in open position.
Figure 12:
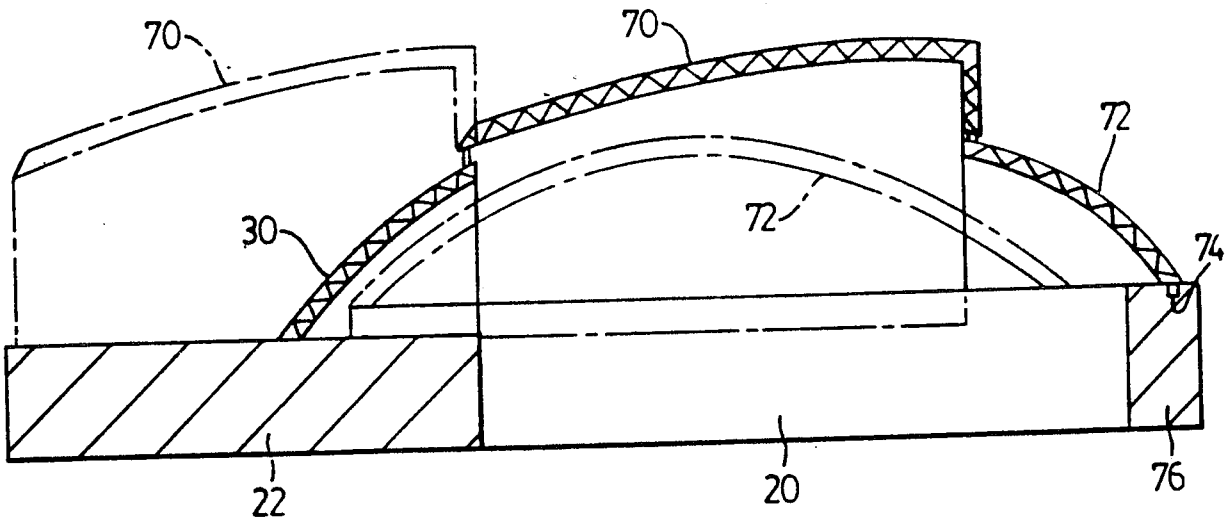
FIG. 12 is a cross-sectional view taken along line 12—12 of FIG. 10.

In the second alternate embodiment of the invention shown in FIGS. 10, 11 and 12 of the drawings the central arch comprises a single barrel vault 70 and a movable end segment 72 which is movable on an arcuate rail 74 fixed on a semicircular end wall 76 to which side wall 20 is tangent. To open the roof of this embodiment, barrel vault 70 is movable on rails 38 back over end wall 22 and end segment 32 is moved along track 72 to an open Position at right angles to its closed position.

The advantage of the second alternate embodiment is economy of space and also of construction costs, as well as allowing for more seats. As in the previous embodiments the central arch may be a single vault or multiple vaults which telescope together. Also, fixed end segment 30 may be merely a wall.

We claim:

1. In a stadium building, a retractable roof comprising a central arch separating a pair of end segments, one end segment being fixed, the central arch being movable from a closed position to an open position above the fixed end segment, the other end segment being movable arcuately laterally from a closed position to an open position axially transverse to its closed position and laterally external to the path of travel of the central arch from the closed position to the open position thereof, the stadium building having a pair of parallel, opposed side walls carrying an assembly of parallel rails with the arch movably mounted thereon, a pair of opposed end walls, one end wall carrying the fixed end segment, the other end wall carrying an arcuate rail assembly with the movable end segment movably mounted thereon, and supporting means outside one of the adjacent side walls and carrying an arcuate rail assembly coextensive with the rail assembly of the said other end wall.

2. A stadium building as claimed in claim 1 in which the supporting means comprises an extension of said other end wall forming therewith a semicircular support for said rail assembly, said one side wall being tangential to the supporting means.

3. In a stadium building, a retractable roof comprising a central arch separating a pair of end segments, one end segment being fixed, the other end segment being movable arcuately laterally to a position axially transverse to its closed position, the central arch having two barrel vaults in side by side relationship, the two barrel vaults being movable into nesting relationship above the fixed end segment with the barrel vault adjacent the movable end segment nesting below the barrel vault which is adjacent the fixed end segment.

4. A stadium building as claimed in claim 3 including an assembly of parallel rails having the arch movably mounted thereon and an arcuate rail assembly having the movable end segment movably mounted thereon.

5. A stadium building as claimed in claim 3 in which the stadium building comprises a pair of parallel, opposed side walls carrying an assembly of parallel rails with the arch movably mounted thereon, a pair of opposed end walls, one end wall carrying the fixed end segment, the other end wall carrying an arcuate rail assembly with the movable end segment movably mounted thereon, and supporting means adjacent one of the side walls and carrying an arcuate rail assembly coextensive with the rail assembly of the said other, end wall.

6. A stadium building as claimed in claim 5 in which the supporting means is integral with said adjacent side wall.

7. A stadium building as claimed in claim 5 in which the supporting means is located outside the adjacent side wall.

8. A stadium building as claimed in claim 5 in which the supporting means is located inside the adjacent side wall.

9. A stadium as claimed in claim 3 in which the movable end segment is angular.

10. A stadium as claimed in claim 8 in which the movable end segment is angular.

11. A stadium as claimed in claim 8 in which the supporting means comprises an extension of said other end wall forming therewith a semicircular support for said rail assembly, said one side wall being tangential to the supporting means.

* * * * *

UNITED STATES PATENT AND TRADEMARK OFFICE

CERTIFICATE OF CORRECTION

PATENT NO. : 5,167,097

DATED : December 1, 1992

INVENTOR(S) : Roderick G. Robbie and Christopher M. Allen

It is certified that error appears in the above-identified patent and that said Letters Patent is hereby corrected as shown below:

Column 2, line 25, cancel "angular" and insert --ungular--.

IN THE CLAIMS

Claim 9, column 4, line 53, cancel "angular" and insert --ungular--.

Claim 10, column 4, line 55, cancel "angular" and insert --ungular--.

Signed and Sealed this

Twenty-sixth Day of October, 1993

*Attest:*

Bruce Lehman

BRUCE LEHMAN

*Attesting Officer*

*Commissioner of Patents and Trademarks*